United States Patent [19]

Hamilton

[11] Patent Number: 4,957,038

[45] Date of Patent: Sep. 18, 1990

[54] VENTILATION DEVICE

[76] Inventor: John G. Hamilton, 95 Warrender Park Rd., Edinburgh, Scotland, EH9 1EW

[21] Appl. No.: 432,315

[22] Filed: Nov. 3, 1989

Related U.S. Application Data

[63] Continuation of Ser. No. 318,646, Mar. 3, 1989, abandoned.

[51] Int. Cl.[5] ..... E06B 7/02

[52] U.S. Cl. ..... 98/87

[58] Field of Search ..... 98/41.3, 87, 97, 98, 98/99.6

[56] References Cited

U.S. PATENT DOCUMENTS 3,094,058 6/1963 O'Brien, Jr. et al. ..... 98/87 X

FOREIGN PATENT DOCUMENTS 110436 6/1984 European Pat. Off. ..... 98/87
3119364 12/1982 Fed. Rep. of Germany ..... 98/87
3124545 1/1983 Fed. Rep. of Germany ..... 98/87
2083203 3/1982 United Kingdom ..... 98/87
2116694 9/1983 United Kingdom ..... 98/87

*Primary Examiner*—Harold Joyce
*Attorney, Agent, or Firm*—Sixbey, Friedman, Leedom & Ferguson

[57] ABSTRACT

A ventilator device (9A) is provided at the side frame (36, 37) of a door (35), especially at the top door standard (37), and comprises a box structure (42) defining a through-conduit for ventilating air, and closed at this ends e.g. by caps (15). The box structure is preferably of L-shaped cross-section so providing an abutment surface (43) for the door. An air-flow control (21, 22) can be provided.

12 Claims, 8 Drawing Sheets

VENTILATION DEVICE

This is a continuation of Ser. No. 318,646, filed 3-3-89, now abandoned.

The present invention relates to a ventilation device for use at a doorway in a building.

Ventilation air flows between rooms and zones in buildings has been achieved by the provision of ventilation devices in doors and also in partition walls of the building. These devices have been installed by cutting a suitable aperture in the door (or in the partition wall) and fitting the device into the aperture. However this arrangement has the disadvantages that fitting of the device is awkward and can weaken the door structure, and further there is often a deleterious effect on asthetic quality of the door or partition wall.

It is an object of the present invention to provide a ventilation device for fitting at a doorway so as to be relatively unobtrusive, but which is convenient to fit and which gives satisfactory ventilation performance.

According to the present invention there is provided a ventilation device comprising an elongate member adapted to service as part of a side frame structure of a doorway, the elongate member including conduit means for the through passage of ventilating air.

Preferably the elongate member is adapted to serve as a top edge member of a doorway, and preferably further the elongate member provides an abutment surface for engagement by a door in the closed position.

In a preferred embodiment the elongate member comprises rises a box structure; and preferably the box structure is of L-shaped cross-section, a shoulder surface of one limb of the L-shaped member constituting said abutment surface.

Embodiments of the present invention will now be described by way of example with reference to the accompanying drawings wherein.

Figure 8:
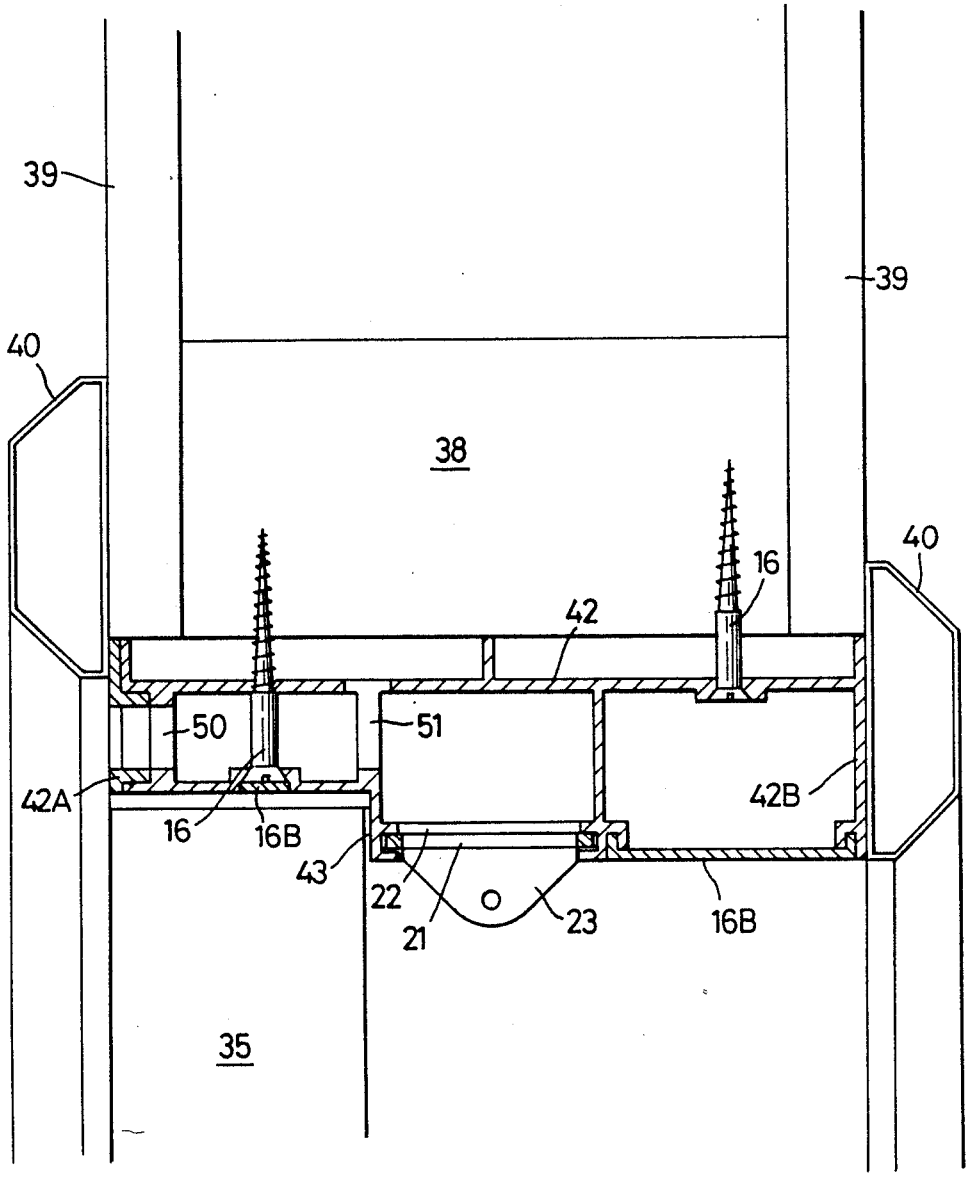

FIG. 8 ia a sectional end view of a fourth embodiment.

Figure 1:
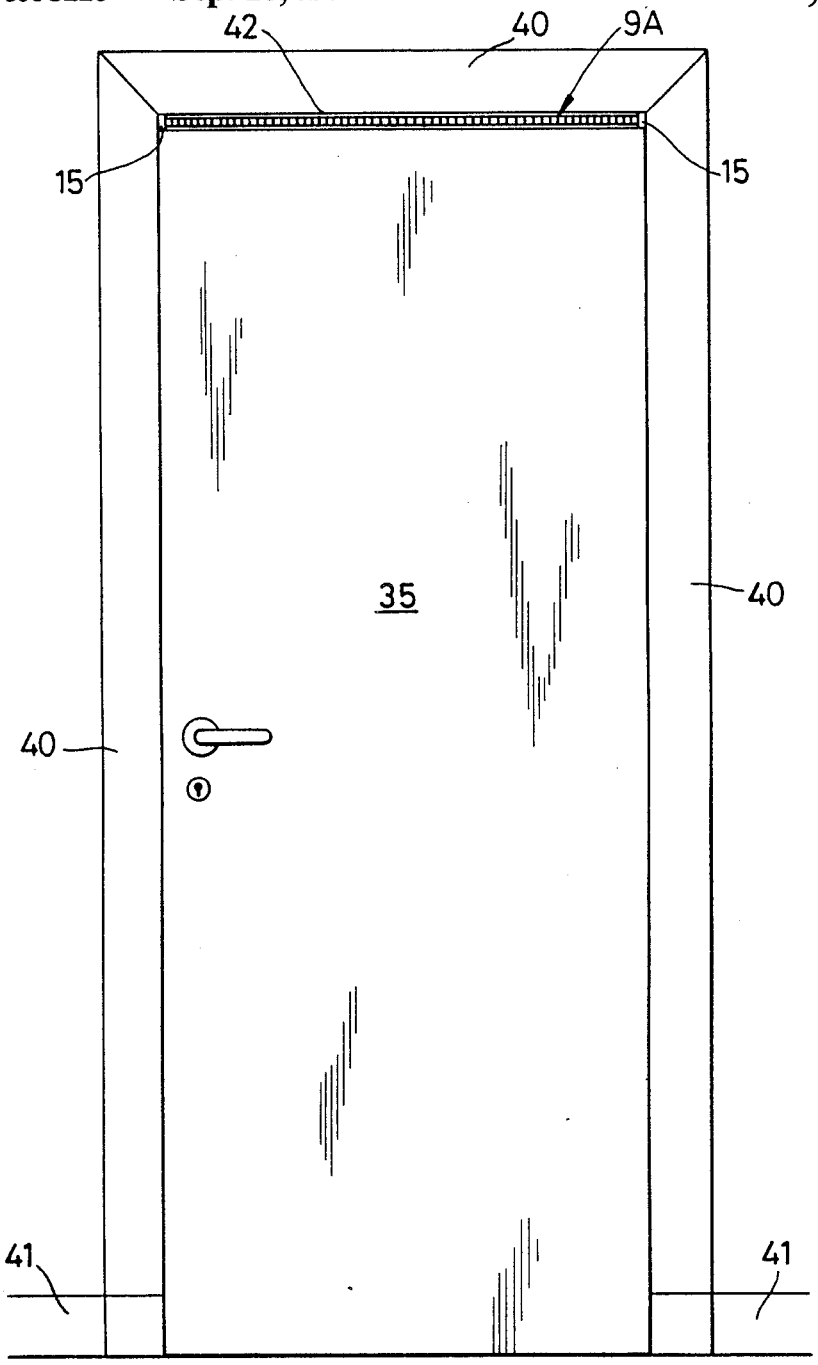
FIG. 1 shows a front view of a door in a domestic dwelling including a ventilator device in accordance with the present invention.
Figure 2:
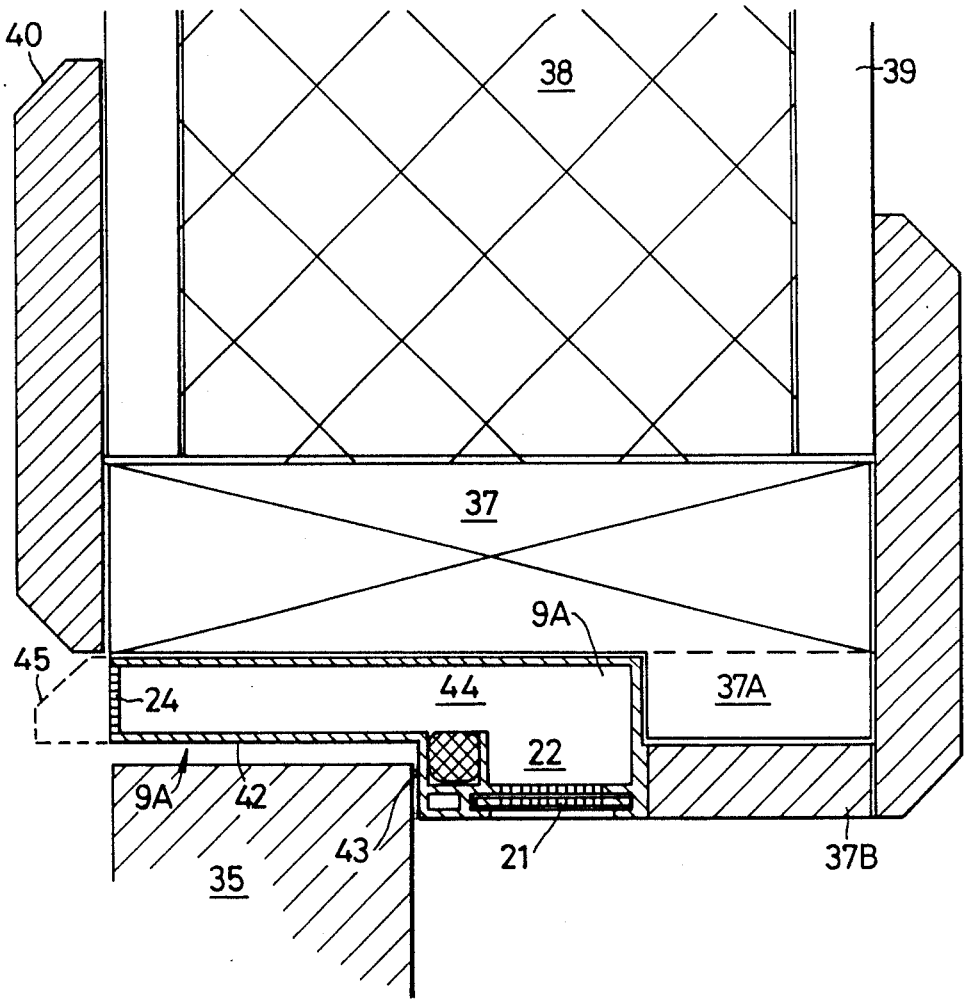
FIG. 2 shows a cross-section side view of the ventilator device of FIG. 8 to a larger scale and through the section C—C in FIG. 1.
Figure 3:
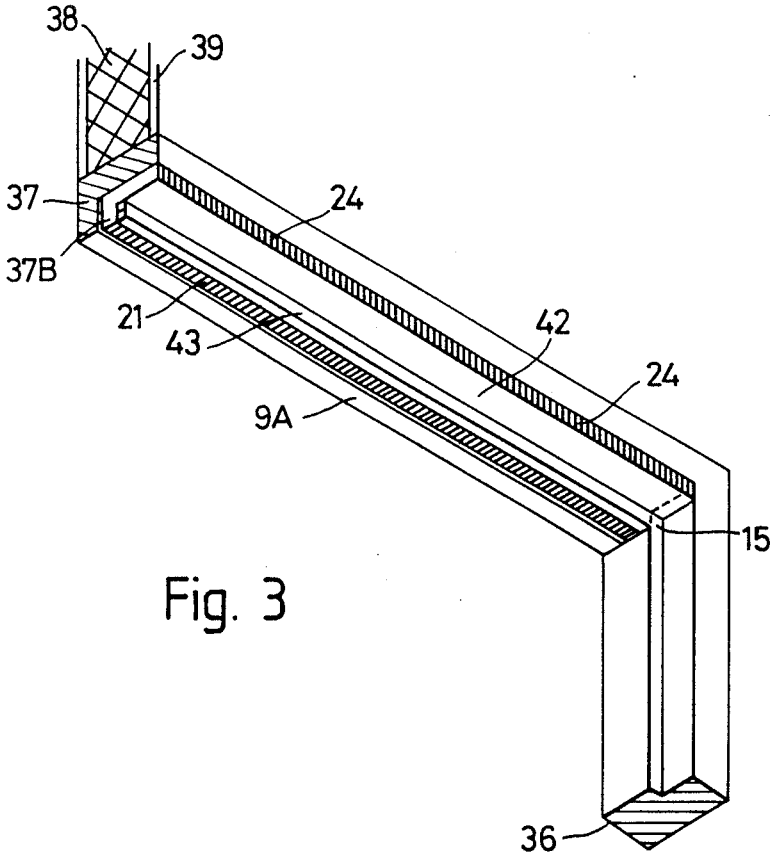
FIG. 3 shows a pictorial view of the ventilator of FIG. 2.

Referring to FIGS. 1 to 3, a vent 9A is fitted at the top of a door 35. The door aperture is provided, in conventional manner, with upright wooden standards 36 and a top transverse standard 37 bounding the wall blockwork 38 surrounding the door aperture The blockwork 38 has plaster surface linings 39, and the normal door facings 40 and bottom skirtings 41 are present. Each of the standards 37, 38 includes step of jamb (stop) portions. The vent 9A comprises a box condiut structure 42 which can be made by an extrusion process. The structure 42 includes an air inlet 24, the outlet 22A being provided with an airflow control comprising a fixed apertured plate 22 and a slidable apertures plate 21 for "hit-and-miss" control with the plate 22. The vent conduit structure 42 is secured to the top standard 37, which can be rebated as shown to accept the conduit.

Alternatively, if the standard 37 is of rectangular cross-section, suitable packing can be provided at zone 7A. The vertical leg of the L-shaping conduit 42 presents a wall surface 43 serving as a door stop, and the conduit's vertical leg will have an appropriate length to meet the particular application eg. for fire door use.

An additional door stop strip 37B is secured to standard 37. The ends of the conduit structure 42 are closed by appropriate end caps 15.

For use with fire doors, the conduit structure 42 can include a channel to house a fire safety element 44 comprising for example an intumescent fire strip. The conduit structure 42 could house baffle means such as for example of cartridge form. Futher, a clip-on cover or nose drip 45 can be located at the inlet 24, especially where the door 35 is an external door (opening outwardly in this case).

The above vent 9A provides a very simple efficient and effective means of secondary ventilation through buildings involving the passage of air over the head of the door rather than via vents fitted into apertures in the door, or through an opening on the partition or wall enclosure.

The conduit structure 42 can comprise a simple extruded box section (with various possible adaptations for fly screens, thermal or sound baffle cartridges as per the window vent type etc.) which replaces the top door stop on the door standard or door set. Individual vents would be cut (to the full internal size of door set)from a long length of extruded suction and, along with end caps etc., the full assembly would then be screwed up onto the top standard thus providing the door stop as well as the ventilator.

The conduit can either be fired into a pre-rebating standard or planted straight onto the standard as illustrated. The door stops can either be "part only" to line through with width of projectiong section of vent unit or packed out and taken full width of door standard without any complications.

The section could be formed in a number of different materials and could have a number of control systems.

The above vent device for doors has the following advantages:

1. The system is very simple, unobtrusive and aesthetically pleasing thus providing a very acceptable able means of secondary through ventilation in buildings.
2. The system doubles up at a door stop—and this is required in any event.
3. The system allows for easy control of ventilation if required.
4. The system can be either installed "on site" or in the factory in pre-fabricated door standards or sets.
5. The system can be manufactured simply (only one main section type) in a number of materials depending upon specification of finish required. Individual vents would be cut from long lengths as required.
6. Sound or thermal baffle cartridges can be easily incorporated if required similar to window vent system as shown in UK Pat. Appln. Nos. 8712477 and 8715570.

Figure 4:
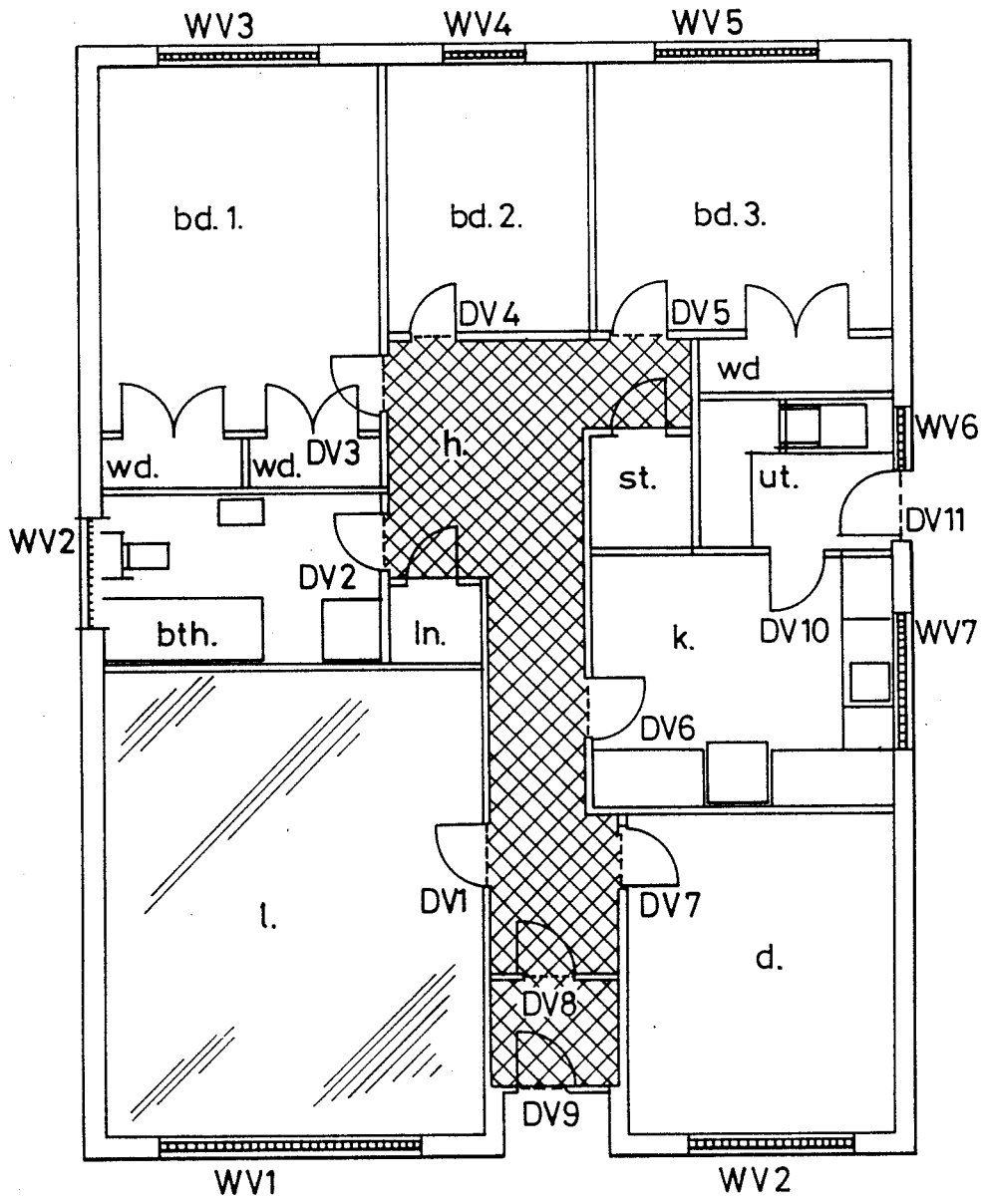
FIG. 4 shows a plan of a domestic dwelling provided with ventilation device in accordance with the present invention and also with ventilation devices located at the windows.

7. Because of the form of the vent system it is possible to incorporate a means of "fire stop" (unlike most other systems) although fire stopped vents would require to be made in steel or other non-combustable material FIG. 4 shows an environment system utilising various window vents (WV) in accordance with UK Patent application 8712477 and door vents DV), the vents DV being as above described and in accordance with the present invention. The environment system provides an almost infinitely variable number of arrangements for secondary (trickle) ventilation for buildings.

The system provides the following range of options:

1. Door VENT system only permanent and non controllable);
2. Door VENT system only controllable—manual or automatic);
3. Window VENT system only (permanent and non controllable);
4. Window VENT system only (controllable—manual or automatic);
5. Full VENT (door and window) system (permanent and non-controllable);
6. Full VENT (door and window) system (controlable—manual or automatic).

A. Each of the above systems can be fitted with sound baffle cartridges or fly screens if required providing further permutations.

B. For controllable vents, automatic control can be provided by a number of methods:

(1) On an individual room (or ventilator) basis by means of a humidity sensor and/or mechanism (electrical, mechanical or organic) located within each VENT unit. This system would provide a very efficient particular control only in rooms requiring ventilation.

(2) On a general basis by means of a centrally located humidity sensor and with links to each VENT control thus providing uniform conditions in each room.

(3) On very high specification installations a small computer could be incorporated to provide even more finely tuned control.

By means of only the two basic VENT systems (door and window openings) and the possibility of sound or thermal baffle 'cartridges' complete control of the environment is very easily maintained The simplicity, efficiency and flexibility of the present Environment System provides for the possibility of highly tuned natural secondary ventilation from zero air changes up to many times the minimum Building regulation standards.

Specifically FIG. 4 shows a typical five apartment house layout demonstrating may of the Environment ststems.

The essence of the above Environment Systems is one of considering the control and efficiency of secondary ventilation of buildings as a science in its own right rather than the traditional idea of ventilators being considered like accessories for windows and doors.

The control units for the various window and door vents WV, DV are shown schematically as item C (CO being such units in the open condition). The cross hatching shows home areas, specifically the lounge and hall, in a ventilated mode by means of the open control units CO.

Figure 5:
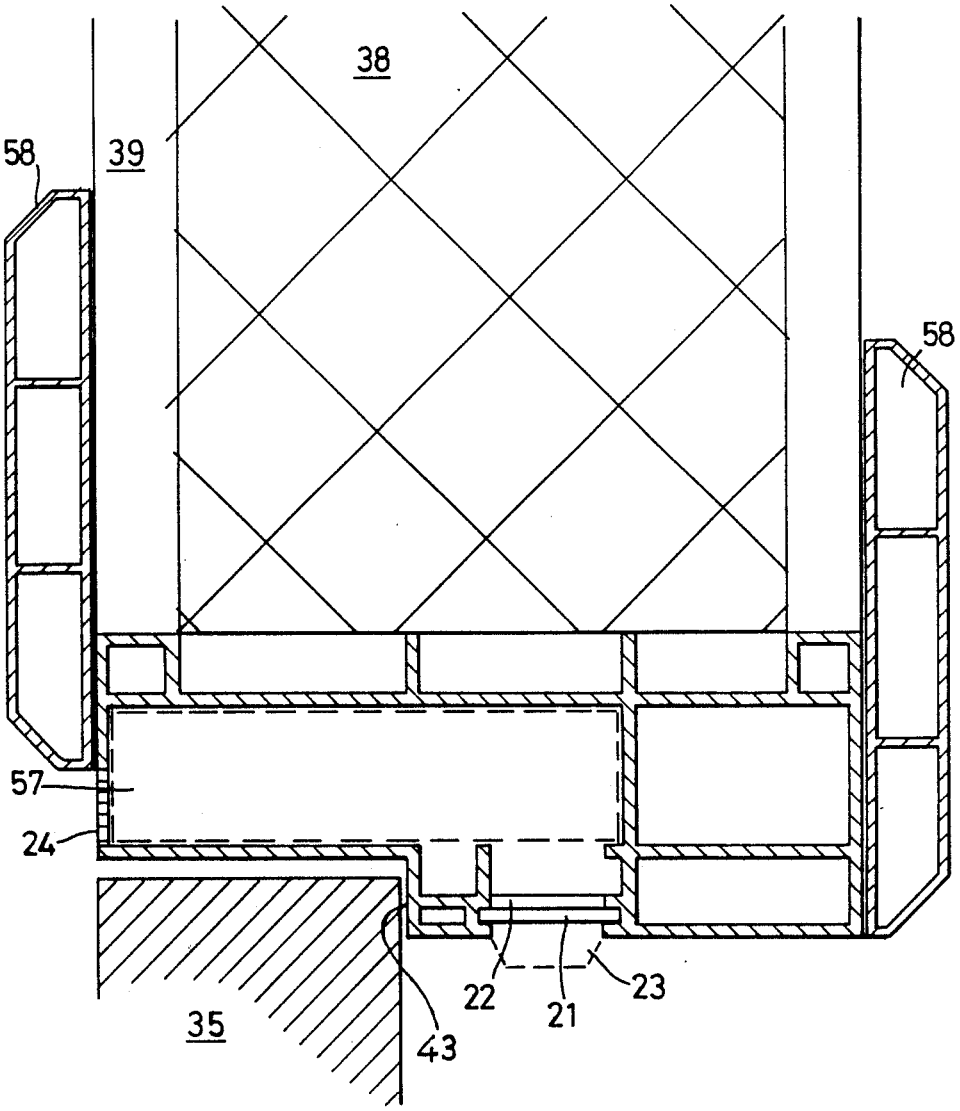
FIG. 5 shows a cross-sectional elevational end view of a ventilation device in accordance with the present invention fitted at a door aperture and in accordance with a second embodiment.

The embodiment shown in FIG. 5 is applied in a door like the embodiment of FIGS. 1 to 3 and like parts carry like reference numerals. However in this case the door head frame member is formed as a cellular form plastics extrusion 56. Integral with the extrusion 56 is a door vent 57 generally similar to the vent 9A of FIG. 1. As previously, a sound proof baffle could be installed in the vents 52 or 57.

As an alternative to the plastics extrusion construction it would be possible to have the vent structure formed integral with a metal form frame member at an aperture. For example this metal form frame member could take the form of an aluminum extrusion.

Figure 6:
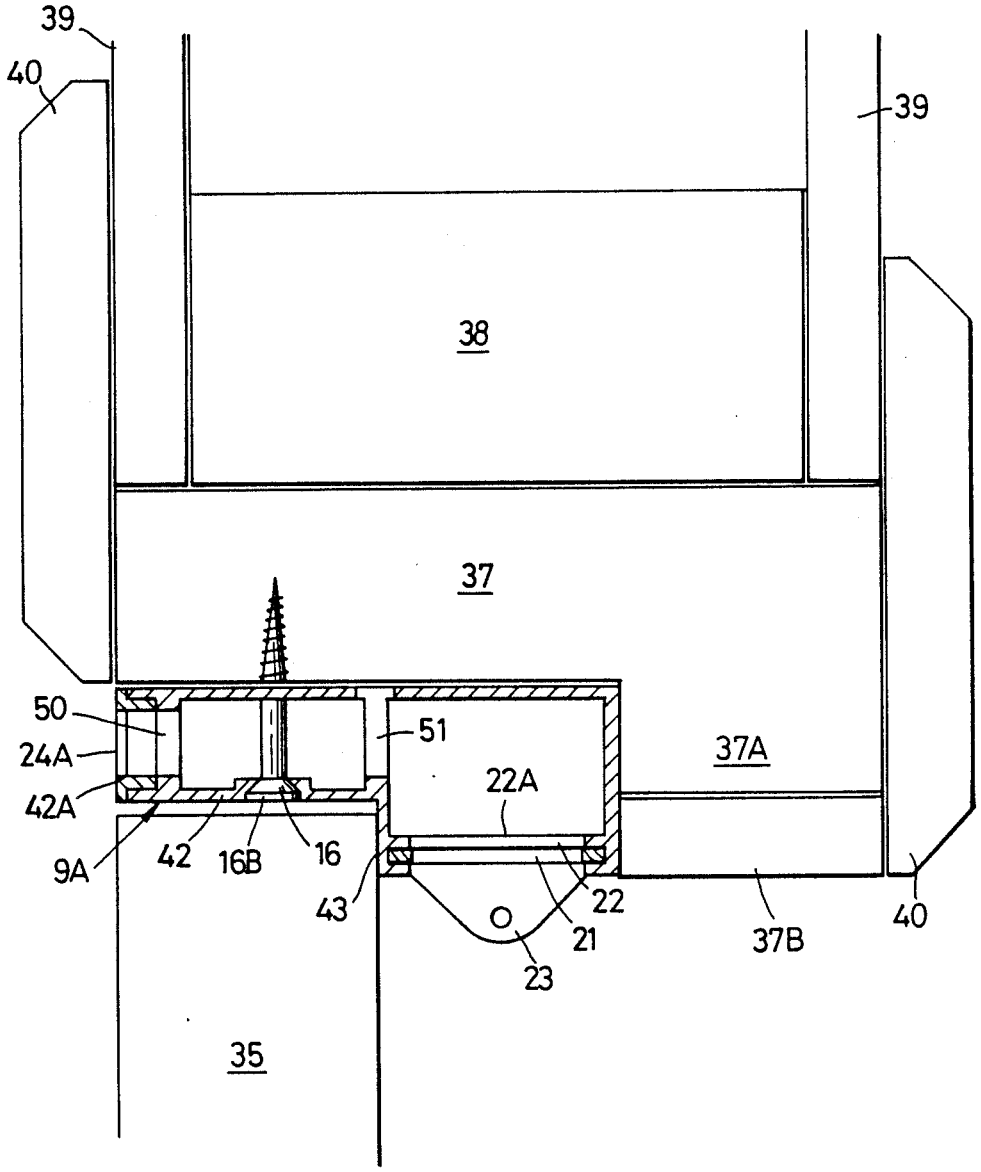
FIG. 6 shows a sectional end view of a third embodiment.
Figure 7:
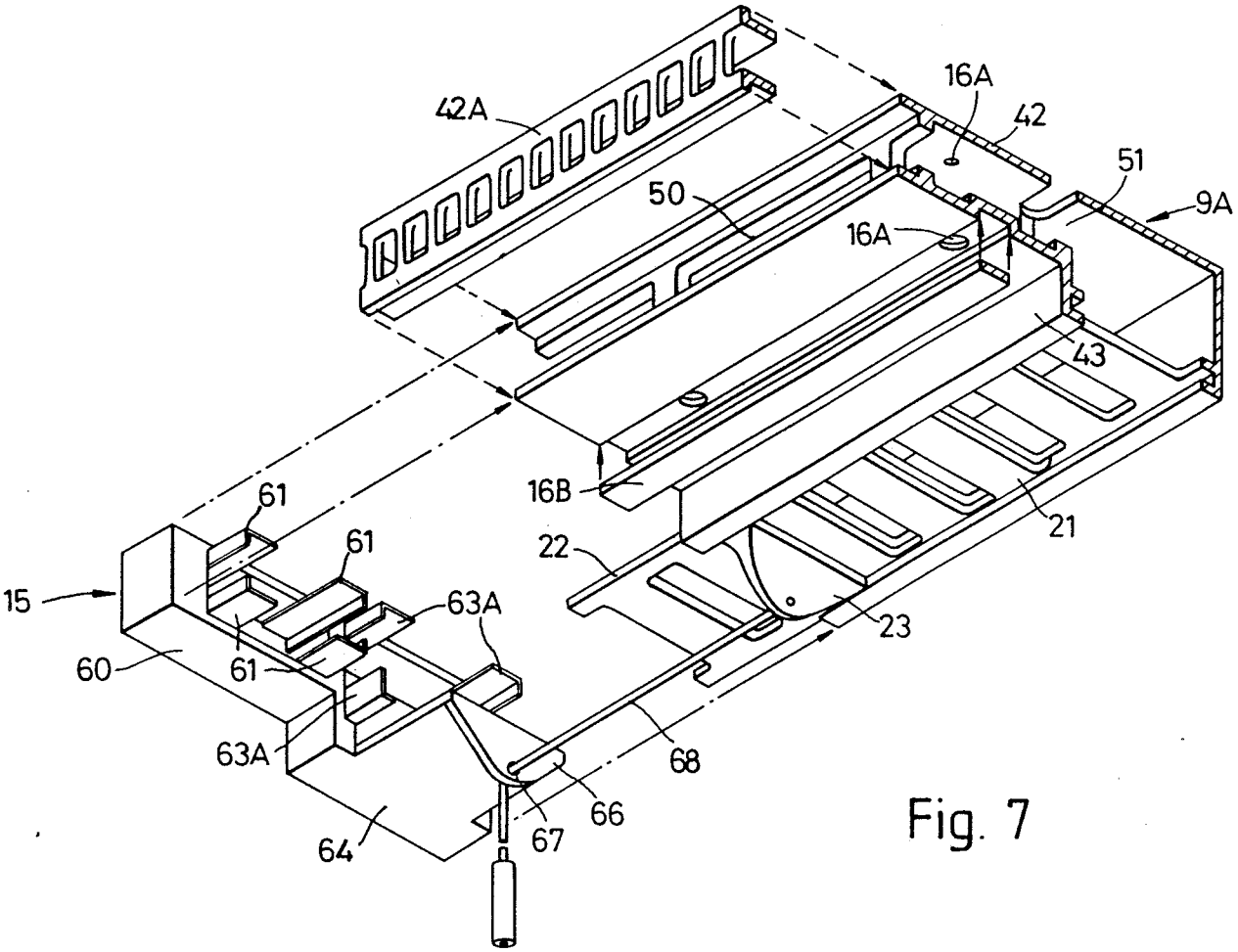
FIG. 7 is an exploded pictorial view of the FIG. 3 embodiment.

FIGS. 6 and 7 show a vent 9A in accordance with another embodiment of the present invention fitted at the top of doorway 35—exactly of the construction shown in FIG. 1, and the vent 9A is basically similar to the vents 9A of the previous embodiments.

The conduit 42 is secured by screws 16 to the top standard 37, which can be rebated as shown to accept the conduit.

Alternatively, if the standard 27 is of rectangular cross-section, suitable packing can be provided at zone 37A. Again the vertical leg of the L-shaped conduit 42 presents a wall surface 43 service as a door stop, and the conduit's vertical leg will have an appropriate length to meet the particular application eg. for fire door use. An additional door stop strip 37B is secured to standard 37. A horizontal air discharge 22A is present as in the previous embodiment, and again a control strip 21 is provided for air flow control. The ends of the conduit 42 can be closed by appropriate end caps 15 as previously and generally like parts carry like reference numerals.

The sides 24A, 22A of the conduit structure 42 at the air inlet and the air outlet respectively carry a series of apertures 50, 51 on internal longitudinal walls for lateral airflow through the conduit 42. Each end cap 15 (see FIG. 7) comprises a decessed base part 60 carrying a set of lugs or tongues 61 and 63A with interior corners of the conduit structure 42. Further, the base part 60 presents a laterally directed tab plate 64 on which an end of the air flow control plate 21 is slidable, the tab plate 64 serving to close off a respective end portion of the air flow control 21/22 so that effective air flow control is always possible from zero to maximum rates.

Cord controls can be fitted or control can be by means of recessed mechanism within vertical door frames of vertical door stops.

Thus as shown in FIG. 2, an operating cord 68 is connected to a laterally extending finger grip 23 of the plate 21, and extends to the sides of the vent 9A where it passes through a hole 67 in a downstand bracket 66 on the tab plate 64 and then downwardly to the operating position, so enabling convenient remote control of the vent 9A located at the top door standard.

To facilitate matching requirements and interchangable nose part 42A is provided insertable into a recess in the main conduit 42 and can have various shapes, sizes, colours etc. A strip 16B is fitted into a recess of the conduit 42 to cover the screwheads of screws fitted through apertures 16A.

The conduit 42 can comprise a simple extruded box section (with various possible adaptations for fly screens, thermal or sound baffle cartridges as per the window vent type etc.) which replaces the top door stops on the door standard or door set individual vents would be cut (to the full internal size of door set) from a long length of extruded section and along with end caps etc. The full assembly wound then be screwed up onto the top standard thus providing the door stop as well as the ventilator.

The conduit can either be fixed into a prestandard or planted straight onto the standard as illustrated. The door stops can either be "part only" to line through with width or projecting section of vent unit or packed out and taken full width of door standard without any complications.

In the embodiment of FIG. 8 a vent 9A is again provided for the top of a doorway but in comparison with the vent of FIGS. 12–14, the vent of FIG. 15 is designed to include structure replacing the top transverse door standard 37, and for this requirement the conduit 42 includes, a back portion 42B. In this example the conduit 42 is screwed directly into the top blockwork 38, and the conduit portion 42B can include an access plate 16B for access to fixing screws 16.

I claim:

1. A ventilation device for use at a door, comprising an elongate member adapted to serve as part of a side frame structure of a doorway, said elongate member comprising a box structure which is L-shaped in transverse cross-section, the box-structure being adapted such that the shorter leg projects laterally so as an overhang a door and serve as a stop for the door, an air conduit being defined between spaced walls of the box structure for through passage of ventilating air, said elongate structure including an inlet port to said conduit and a discharge port from the conduit, one of said ports being located in the shorter leg of the box structure such that said one port faces downwardly, and a reinforcing structure extends between the spaced wall portions of the box structure in said shorter leg, said reinforcing structure defining openings for passage of air via said one port in the shorter leg.

2. A ventilation device as claimed in claim 15, wherein the reinforcing structure comprises an apertured wall.

3. A ventilation device as claimed in claim 15, wherein said one port comprises the discharge port.

4. A ventilation device as claimed in claim 15, wherein the elongate member is adapted to serve as a top edge member of a doorway.

5. A ventilation device as claimed in claim 4, wherein the elongate member is adapted to be secured to a top door transverse standard member of a doorframe.

6. A ventilation device as claimed in claim 4, wherein the elongate member comprises a top door transverse standard member of a doorframe.

7. A ventilation device as claimed in claim 1, wherein the elongate member is in the form of a vent assembly including a main duct body and nose and outlet portions on either side of said main duct body; at least one of said nose interchangeable unit, joining means being provided for the connection of said one portion to the main duct body.

8. A ventilation device as claimed in claim 1, wherein an air flow control is provided at the air discharge port.

9. A ventilation device as claimed in claim 8, wherein the air flow control comprises a first plate of aperture from and a relatively movable second plate controlling air flow through the first plate.

10. A ventilation device as claimed in claim 9, wherein actuating means are fitted to control element for remote operation of the second plate.

11. A ventilation device as claimed in claim 9, wherein ends of the box structure are closed by fitted end caps each of the fitted end caps including a lateral plate which overlaps a respective end portion of said first plate.

12. A ventilation device as claimed in claim 1, wherein the elongate member is made of plastic material and is formed by an extrusion process.

* * * * *